US007827628B2

(12) United States Patent
Ichiki et al.

(10) Patent No.: US 7,827,628 B2
(45) Date of Patent: Nov. 9, 2010

(54) FLUSH TOILET

(75) Inventors: Tomoyasu Ichiki, Fukuoka (JP); Tsuyoshi Ozeki, Fukuoka (JP); Toshifumi Yoneda, Fukuoka (JP); Shinji Shibata, Fukuoka (JP); Shuichi Nagashima, Fukuoka (JP)

(73) Assignee: Toto Ltd. (JP)

( * ) Notice: Subject to any disclaimer, the term of this patent is extended or adjusted under 35 U.S.C. 154(b) by 0 days.

(21) Appl. No.: 11/836,518

(22) Filed: Aug. 9, 2007

(65) Prior Publication Data

US 2007/0277302 A1 Dec. 6, 2007

Related U.S. Application Data

(63) Continuation of application No. PCT/JP2006/302242, filed on Feb. 9, 2006.

(30) Foreign Application Priority Data

Feb. 10, 2005 (JP) ..... 2005-034797

(51) Int. Cl.
*E03D 11/00* (2006.01)

(52) U.S. Cl. ..... 4/420; 4/421

(58) Field of Classification Search ..... 4/420, 4/421

See application file for complete search history.

(56) References Cited

U.S. PATENT DOCUMENTS

| | | | | |
|---|---|---|---|---|
| 2,558,680 | A * | 6/1951 | Groff | 4/331 |
| 5,706,529 | A * | 1/1998 | Kai et al. | 4/370 |
| 6,145,138 | A | 11/2000 | Nakamura et al. | |
| 6,986,172 | B2 * | 1/2006 | Hidetaka et al. | 4/425 |
| 7,111,333 | B1 * | 9/2006 | Lo et al. | 4/420 |
| 2003/0115664 | A1 | 6/2003 | Kosugi et al. | |
| 2004/0040080 | A1 | 3/2004 | Prokopenko et al. | |
| 2006/0005310 | A1 * | 1/2006 | Nakamura et al. | 4/420 |

FOREIGN PATENT DOCUMENTS

| | | | |
|---|---|---|---|
| DE | 1817631 | A1 | 6/1970 |
| JP | 3-128774 | | 12/1991 |
| JP | 0748779 | | 11/1995 |
| JP | 11-061950 | | 3/1999 |
| JP | 2003-129550 | | 5/2003 |
| JP | 2004100307 | | 2/2004 |
| JP | 2004-100307 | | 4/2004 |
| WO | 2004-022862 | A | 3/2004 |
| WO | 2004018786 | A | 3/2004 |
| WO | WO 2004022862 | A1 * | 3/2004 |

* cited by examiner

*Primary Examiner*—Tuan N Nguyen
(74) *Attorney, Agent, or Firm*—Brooks Kushman P.C.

(57) ABSTRACT

A flush toilet is provided having a bowl portion with a bowl-shaped waste-receiving surface and a rim portion the inside wall surface on the top edge of which protrudes inward. A trap pipe is connected to the bottom portion of the bowl portion. A first shelf portion is formed to follow the rim and a second shelf portion is formed on the waste receiving surface below the first shelf portion projecting above the initial accumulated water level. An orifice for issuing water into the first shelf portion and forming a swirl flow in the waste receiving surface is provided along with a second orifice for issuing water into the second shelf portion for forming a flow to swirl water within the bowl portion is further provided with first and second flow paths for respectively supplying water to the first and second orifices.

17 Claims, 5 Drawing Sheets

FLUSH TOILET

CROSS-REFERENCE TO RELATED APPLICATIONS

This is a continuation of PCT international application no. PCT/JP2006/302242, with an international filing date of Feb. 9, 2006, which claims priority to JP 2005-034797, filed Feb. 10, 2005, which are hereby incorporated by reference in their entirety.

TECHNICAL FIELD

The present invention relates to a flush toilet, and more particularly to a flush toilet in which the toilet is washed down with flush water to expel waste.

BACKGROUND ART

Japanese Utility Model Patent Laid-Open (Patent document 1) describes a wall-hung one-piece toilet. Because the mounting of such wall-hung flush toilets away from floor surfaces yields the advantage of good floor cleanability, such toilets are in ever wider use.

A flush toilet in which the toilet bowl is cleaned by a swirl flow of flush water issued from an upper portion of the bowl portion is set forth in Japanese Patent Laid-Open No. 2004-100307 (Patent Document 2). Since such flush toilets, in which the bowl surface is cleaned by a swirl flow, do not have a box rim or the like causing flush water to be issued downward from the edge of the bowl portion, their shape is simple and cleanability of the bowl portion superior, hence they are widely used.

Patent document 1

Japanese Utility Model Patent Laid-Open No. H03-128774

Patent Document 2

Japanese Patent Laid-Open No. 2004-100307

DISCLOSURE OF THE INVENTION

Problems the Invention is to Solve

In the wall-mounted flush toilet set forth in Japanese Utility Model Patent Laid-Open H03-128774, however, the flush toilet drain pipe must for structural reasons be connected to a sewer pipe disposed on a wall surface. When the drain pipe is connected to a wall surface sewer pipe, the height difference between the flush toilet water surface and the sewer pipe connected thereto is reduced, making it difficult to induce a strong siphon action in the flush toilet. It is therefore common in wall-mounted flush toilets to employ a washdown system which does not use siphon action, or a similar cleansing system which does not make much use of siphon action.

In the flush toilet set forth in Japanese Patent 2004-100307, in which the bowl portion is washed down using a swirl flow, the flush water flows in such a way as to drop downward as it swirls within the bowl portion, thus making the flow of flush water from top to bottom in the bowl portion weaker than in flush toilets having a box rim or the like. In such cases in which the flow of flush water from top to bottom is weak, the capacity to expel waste floating in water accumulated in the bowl portion is particularly reduced. It is therefore common in flush toilets in which a swirl flow is used to cleanse the bowl portion to use a strong siphon action to suction accumulated water up to a trap pipe inlet within the bowl portion when flushing, thereby expelling any floating waste.

It is therefore difficult to apply a washdown system, which cleanses the bowl portion using a swirl flow, to flush toilets in which it is difficult to induce strong siphon action, such as wall-mounted toilets.

Therefore the present invention has the object of providing a flush toilet capable of effectively expelling waste with a flush system which uses a swirl flow rather than a strong siphon action.

Means for Solving the Problem

In order to solve the above-described problem, the first invention of the present invention is a flush toilet in which flush water cleanses the toilet and expels waste, comprising a bowl portion furnished with a bowl-shaped waste-receiving surface and a rim portion on the top edge of which an inside wall surface protrudes inward; a trap pipe connected to and extending from the bottom of the bowl portion to expel waste, defining the initial accumulated water level of the bowl portion; a first shelf portion formed on the top edge of the waste-receiving surface following the rim portion; a second shelf portion formed on the waste-receiving surface below the first shelf portion and above the initial accumulated water level; a first orifice for issuing flush water onto the first shelf portion, forming a swirl flow on the waste-receiving surface; a second orifice for issuing flush water onto the first shelf portion, forming a flow for stirring flush water in the bowl portion; a first flow path for supplying flush water to the first orifice; and a second flow path for supplying flush water to the second orifice.

In the present invention thus constituted, when the bowl portion is being flushed, flush water issued from the first orifice flows along the first shelf portion and into the bottom portion of the bowl portion, cleaning the waste-receiving surface of the bowl portion as it swirls. At the same time, flush water issued from the second orifice flows down into the bottom portion of the bowl portion as it flows along the second shelf portion, thereby stirring accumulated water in the bowl portion in an up down motion. Stirring of the accumulated water in the bowl portion causes floating waste which had been floating on the surface of the accumulated water prior to flushing to sink into the accumulated water, and floating waste, along with waste which had sunk into the accumulated water and flush water, to be expelled through the trap pipe.

In the present invention thus constituted, flush water issued from the second orifice stirs the accumulated water and causes floating waste to sink into the accumulated water, therefore floating waste can be reliably expelled even in flush toilets with a cleansing system using a swirl flow, which have a low capacity for stirring accumulated water.

In the first invention of the present invention, the second shelf portion is preferably formed close to the highest height to which the level of the accumulated water in the bowl portion rises when flushing.

In the present invention thus constituted, flush water issued from the second orifice flows into the accumulated water at a level slightly above the second shelf portion or a little lower than the second shelf portion, thus making it possible to avoid collision with flush water flowing in a downward spiral via the first shelf portion, thereby enabling effective stirring of the accumulated water while preventing splashing of the flush water.

In the first invention of the present invention, the second shelf portion preferably extends from the rear to the side surface of the bowl portion.

In the present invention thus constituted, flush water issued from the second orifice flows along the second shelf portion and hits the tip of the second shelf portion positioned on the side surface of the bowl, flowing into the accumulated water.

In the present invention thus constituted, a portion of the flush water issued from the second orifice flows downward from the side surface of the bowl portion, therefore a rotating flow centered on an axial line extending from the front to the rear of the bowl portion is induced, enabling floating waste to be effectively caused to sink into the accumulated water.

In the first invention of the present invention thus constituted, the second shelf portion preferably extends in an approximately "J" or reverse "J" shape from the rear toward the front of the bowl portion.

In the present invention thus constituted, flush water issued from the second orifice flows along the approximately "J" or reverse "J" shaped second shelf portion, hitting the tip of the second shelf portion positioned at the front of the bowl portion and flowing into the accumulated water.

In the present invention thus constituted, a portion of the flush water issued from the second orifice flows from the front to the rear of the bowl portion, aiding the action of expelling waste into the trap pipeline.

A second invention of the present invention is a flush toilet in which flush water cleanses the toilet and expels waste, comprising a bowl portion having a bowl-shaped waste-receiving surface and a rim portion, the inside wall surface on the top edge of which protrudes inward; a trap pipe connected to and extending from the bottom of the bowl portion, defining the initial accumulated water level of the bowl portion; a first shelf portion formed on the top edge of the waste-receiving surface following the rim portion; a first orifice for issuing flush water onto the first shelf portion, forming a swirl flow on the waste-receiving surface; a second orifice formed at a height below the first shelf portion and above the initial accumulated water level for issuing flush water from the font of the bowl portion toward the trap pipe inlet; a first flow path for supplying flush water to the first orifice; and a second flow path for supplying flush water to the second orifice.

In the present invention thus constituted, flush water issued from the first orifice when cleansing the bowl portion flows along the first shelf portion, cleans the waste-receiving surface of the bowl portion as it swirls, and flows into the bottom of the bowl portion. At the same time, flush water issued from the second orifice flows from the front of the bowl portion toward the intake of the trap pipe, stirring the accumulated water in the bowl portion in an up and down motion. By stirring the accumulated water in the bowl portion, floating waste which had been floating on the surface of the accumulated water prior to flushing is caused to sink into the accumulated water, and the floating waste is expelled through the trap pipe together with any waste which had sunk into the accumulated water and the flush water.

In the present invention thus constituted, flush water issued from the second orifice stirs the accumulated water and causes floating waste to sink into the accumulated water, therefore floating waste can be reliably expelled even in flush toilets using a swirl flow with a low capacity for stirring the accumulated water.

In a second invention of the present invention, a second orifice is preferably formed in the vicinity of the top height to which the accumulated water level in the bowl rises when flushing. In the invention so constituted, the flush water issued from the second orifice flows into the accumulated water at a water level slightly higher than the second orifice or a little lower than the second orifice, making it possible to avoid collision with flush water issued from the first orifice flowing downward as it swirls via the first shelf portion, and to effectively stir the accumulated water while preventing splashing of the flush water.

In the first or second inventions of the present invention, the accumulated water level in the bowl portion is preferably always higher than the aforementioned initial accumulated water level at the time of flushing. In a flush toilet thus constituted a siphon action does not occur, or siphon action is extremely weak, making it difficult to expel floating waste by siphon action. By applying the present invention to this type of flush toilet, floating waste can be reliably expelled from a trap pipe without using siphon action.

In the first and second invention of the present invention it is also preferable that the trap pipe outlet be connected to sewer piping installed on a wall surface. For structural reasons, the level difference between the level of accumulated water in the bowl portion and the sewer piping is small in a flush toilet constituted this way, making it difficult to generate a strong siphon action. By applying the present invention to a flush toilet of this type, waste as well as floating waste can be reliably expelled from the trap pipe without use of siphon action.

The first or second invention of the present invention preferably comprises a wall-hung flush toilet. For structural reasons, the level difference between the level of accumulated water in the bowl portion and the sewer piping is small in a flush toilet constituted this way, making it difficult to generate a strong siphon action. By applying the present invention to a wall-hung flush toilet of this type, floating waste can as well be reliably expelled from the trap pipe without use of siphon action.

EFFECT OF THE INVENTION

Using the flush toilet of the present invention, floating waste can be effectively expelled by a cleansing system which utilizes a swirling current, without use of a strong siphon action.

BEST MODE FOR PRACTICING THE INVENTION

We next explain preferable embodiments of the present invention with reference to the attached figures. First, referring to FIGS. 1 through 3, we explain a flush toilet according to a first embodiment of the present invention. FIG. 1 is a side elevation section of a flush toilet according to a first embodiment of the present invention; FIG. 2 is a plan view thereof, and FIG. 3 is a front elevation section through line III-III in FIG. 1.

As shown in FIGS. 1 through 3, the flush toilet 1 according to the first embodiment of the invention has a bowl portion 2 and a trap pipe 4 connecting from the bottom of the bowl portion 2 and extending therefrom. Also, the flush toilet 1 according to the present embodiment is constituted as a wall-hung toilet.

The inner wall of the top edge of the bowl portion 2 protrudes inward forming a rim portion 2*a*. A waste-receiving surface 2*b* for receiving waste is formed underneath the rim portion 2*a*.

A trap pipe 4 extends diagonally upward from an inlet 4*a* opening on the bottom of the bowl portion 2, and after passing through a highest point 4*b*, extends diagonally downward to reach an outlet 4*c*. When the flush toilet 1 is used, the initial accumulated water level L, which is the accumulated water level during standby, becomes equal with the height of the trap pipe 4 highest point 4*b*. Therefore the flush toilet 1 water level L is determined by the shape of the trap pipe 4.

A first shelf portion 6 extending in an approximately horizontal plane is formed along the bowl portion 2 rim portion 2*a*. This first shelf portion 6 extends from approximately the left rear portion of the bowl portion 2 through the front of the bowl portion 2 up to the right rear portion thereof along the inner perimeter of the bowl portion 2. Moreover, the first shelf portion 6 is formed at an incline such that the inner perimeter portion is lower than the outer perimeter portion thereof.

Moreover, a first orifice 10 for issuing flush water is formed at the base end of the first shelf portion 6 which is positioned at the left rear of the bowl portion 2. The flush water issued from the first orifice 10 drops downward while swirling over the inner perimeter of the rim portion 2*a* along the first shelf portion 6, cleansing the waste-receiving surface 2*b*.

A second shelf portion 8 extending on an essentially horizontal plane is formed in the middle of the bowl portion 2 waste-receiving surface 2*b*. A bowl portion 2 second shelf portion 8 extends from approximately the left rear of the bowl portion 2 up to the second shelf front edge 8*a* at essentially the middle of the bowl portion 2 side portion. The second shelf portion 8 is formed at an incline such that the inner perimeter portion is lower than the outer perimeter portion. Moreover, a protruding portion 9 is formed above the second shelf portion 8 so as to cover over the second shelf portion 8. When flushing, the water level of the accumulated water in the bowl portion 2 rises from the initial accumulated water level to essentially the height at which the second shelf portion 8 is installed due to the inflow of flush water into the bowl portion 2. Therefore the second shelf portion 8 is formed at a height which is below the first shelf portion 6 and above the initial accumulated water level.

Moreover, a second orifice 12 for issuing flush water is formed at the base end of the second shelf portion 8 located at the left rear of the bowl portion 2. Flush water issued from the second orifice 12 flows from the slit-shaped gap between the tip of the protruding portion 9 and the inner perimeter portion of the second shelf portion 8 and along the second shelf portion 8 as it falls downward. In addition, the invention is constituted such that essentially the entire quantity of flush water flowing along the second shelf portion 8 flows downward when it reaches the second shelf front edge 8*a*.

A step portion 7 constituted by a near-horizontal inclined surface is formed at a position lower than the initial accumulated water level L below the bowl portion 2. When flushing, a portion of the flush water issued from the second orifice 12 and flowing down through the slit-shaped gap between the tip of the protruding portion 9 and the inner perimeter portion of the second shelf portion 8 collides with the step portion 7, and a portion of the colliding flush water jump upward and then again flows downward. As shown in FIG. 1, the step portion 7 is formed so as to extend from the front of the bowl portion 2 to the tip portion 7*a*, and this step portion 7 is positioned midway in the slit-shaped gap. Therefore flush water flowing down from the tip portion of the slit-shaped gap collides with the step portion 7, and flush water flowing down from the base end portion of the slit-shaped gap goes toward the bottom of the bowl portion 2 as is, without colliding with the step portion 7.

A flow path inlet 18 for guiding the flush water issued from the first orifice 10 and the second orifice 12 is formed at the rear edge of the flush toilet 1. Flush water guided into the flush toilet 1 is supplied to the flow path inlet 18 via a flush valve (not shown) in the water supply. Additionally, flush water guided into the flush toilet 1 from the flow path inlet 18 flows through a shared water path 20 toward the front of the flush toilet 1.

The shared water path 20 is divided at the rear of the bowl portion 2 between a first flow path 14 extending in an essentially horizontal direction along the rear of the bowl portion 2 and a second flow path 16 extending downward from the shared water path 20. The first flow path 14 is constituted to extend along the rear edge of the bowl portion 2 in a horizontal direction from the dividing point on the shared water path 20 to the first orifice 10 on the left rear of the bowl portion 2. The second flow path 16 extends from the shared water path 20 in an essentially vertically downward direction, then extends horizontally, bending forward at essentially the same height as the second shelf portion 8 and connecting with the second orifice 12. In the present embodiment approximately ⅓ of the flush water flowing in from the flow path inlet 18 flows into the first flow path 14, and approximately ⅔ flows into the second flow path 16.

Next we explain the action of the flush toilet 1 according to the first embodiment of the present invention.

First, in the flush toilet 1 standby state the accumulated water in the bowl portion 2 is accumulated up to the initial accumulated water level L, which is the height of the highest point 4*b* of the trap pipe 4. When the user operates the flush valve (not shown) and flushing of the bowl portion 2 is commenced, flush water flows from a water supply line into the flow path inlet 18. The flush water from the flow path inlet 18 flows toward the front of the flush toilet 1 through the shared water path 20 and is further divided into the first flow path 14 and the second flow path 16.

Approximately ⅓ of the flush water flowing into the shared water path 20 flows into the first flow path 14 and is issued from the first orifice 10. Flush water issued from the first orifice 10 at the left rear of the bowl portion 2 flows toward the front of the bowl portion 2 along the first shelf portion 6, then passes the front of the bowl portion 2 and flows in a swirl toward the right rear of the bowl portion 2. Flush water issued from the first orifice 10 swirls around the edge of the bowl portion 2 and flows downward toward the interior of the bowl portion 2, therefore the flush water reaches the bottom of the bowl portion 2 by describing an approximately spiral form. The waste-receiving surface 2*b* of the bowl portion 2 is thus washed by this spiral-shaped flow of flush water. Additionally, centrifugal force acts on flush water issued from the first orifice 10, in a direction which would cause the water to fly out of the bowl portion 2, but because the rim portion 2*a* on the top edge of the bowl portion 2 is formed to protrude inward, the flush water does not fly out of the bowl portion 2.

Meanwhile, approximately ⅔ of the flush water flowing into the shared water path 20 flows into the second flow path 16 and is issued from the second orifice 12. Flush water issued from the second orifice 12 at the left rear of the bowl portion 2 moves toward the front of the bowl portion 2 along the second shelf portion 8 and reaches the second shelf front edge 8*a*. Flush water issued from the second orifice 12 flows along the second shelf portion 8 as well as flowing down toward the inside of the bowl portion 2 from the slit-shaped gap between the tip of the protruding portion 9 and the inner perimeter portion of the second shelf portion 8. Moreover, flush water which has flowed along the second shelf portion 8 and hit the second shelf front edge 8*a* then falls down from that point. Flush water flowing down from the second shelf portion 8 stirs the accumulated water in the bowl portion 2 as it forms an up and down flow indicated by the arrows in FIG. 3 and causes floating waste floating on the accumulated water surface to move toward the bottom of the bowl portion 2 before flushing begins. In addition, a portion of the flush water flowing down from the second shelf portion 8 and colliding with the step portion 7 bounces upward and then again flows downward, thereby strengthening the up and down stirring effect of the flush water such that floating waste is effectively pulled into the accumulated water. Flush water flowing down from the second shelf portion 8 and moving toward the bottom of the bowl portion 2 without colliding with the step portion 7 pulls floating waste as far as the trap pipe 4 inlet 4*a*, effectively expelling it to the outlet 4*c*.

When flush water is issued from the first orifice 10 and the second orifice 12 and begins to flow into the bowl portion 2, the flow volume into the bowl portion 2 is greater than the flow volume of flush water expelled from the bowl portion 2 past the highest point 4*b* on the trap pipe 4, therefore the accumulated water level in the bowl portion 2 gradually rises. The rising accumulated water level reaches the vicinity of the second shelf portion 8 height, therefore floating waste floating on the accumulated water is efficiently caused to sink into the accumulated water by flush water flowing down from the second shelf portion 8.

The flow volume of flush water passing over the highest point 4*b* of the trap pipe 4 and being expelled by the rise of the accumulated water level increases, and the volume of flush water flowing in is reduced due to the gradual reduction in opening angle on the flush valve (not shown), therefore the raised accumulated water finally begins to go down. At this point waste which had sunk in the accumulated water in the bowl portion 2, and floating waste which had been floating on the accumulated water surface prior to flushing and was caused to sink into the accumulated water by the flow of flush water, pass over the trap pipe 4 highest point 4*b* together with the flush water and are expelled from the outlet 4*c* to the plumbing (not shown). After all waste is expelled, the accumulated water level drops even further, and descends to the initial accumulated water level L. The flush toilet 1 of the present embodiment is a wall-hung toilet, in which for structural reasons the height difference between the accumulated water level and the trap pipe 4 outlet 4*c* is extremely small, there is almost no siphon action generated, and the accumulated water level never goes below the initial accumulated water level L during the entire period of the flushing of the bowl portion 2.

According to the flush toilet in the first embodiment of the present invention, flush water issued from the second orifice stirs the flush water in the bowl portion, thereby enabling effective expelling of floating waste without the use of siphon action even in flushing systems using swirl flows.

In the flush toilet of the present embodiment, the second shelf portion is formed at essentially the same height as the height to which the level of the accumulated water in the bowl portion rises during flushing, therefore the accumulated water in the bowl portion can be effectively stirred by the flush water flowing down from the second shelf portion. Flush water from the second shelf portion flows into the bowl portion from immediately above the accumulated water level, therefore there is no collision with flush water flowing downward from the first shelf portion as it swirls, and no water splashing is induced.

Next, referring to FIGS. 4 through 6, we explain a flush toilet according to a second embodiment of the present invention. In the flush toilet according to the second embodiment, the shape of the second shelf portion differs from the first shelf portion. Therefore we will explain only those parts of the second embodiment of the present invention which differ from the first embodiment, and will omit explanations of similar parts.

FIG. 4 is a side elevation section of a flush toilet according to the second embodiment of the present invention; FIG. 5 is a plan view thereof FIG. 6 is a front elevation section along line VI-VI in FIG. 4.

As shown in FIGS. 4 through 6, a flush toilet 100 according to the second embodiment of the present invention has a bowl portion 102 and a trap pipe 104.

The top edge of the bowl portion 102 constitutes a rim portion 102*a*, below which is a waste-receiving surface 102*b*.

The trap pipe 104 has an inlet 104*a*, a highest point 104*b*, and an outlet 104*c*. When the flush toilet 100 is in use, the initial accumulated water level L, which is the accumulated water level during standby, becomes equal to the height of the highest point 104*b* of the trap pipe 104. Therefore the flush toilet 100 initial accumulated water level L is determined by the shape of the trap pipe 104.

A first shelf portion 106 extending on an essentially horizontal plane is formed along the rim portion 102*a* of the bowl portion 102. The shape of this first shelf portion 106 is the same as that in the first embodiment, hence an explanation thereof is here omitted. Moreover, a first orifice 110 for issuing flush water is formed at the base end of the first shelf portion 106, which is positioned at the left rear of the bowl portion 102.

A second shelf portion 108 extending on an essentially horizontal plane is formed in the middle of the bowl portion 102 waste-receiving surface 102*b*. This second shelf portion 108 extends from approximately the left rear of the bowl portion 102 to the bowl portion 102 second shelf front edge 108*a*, describing a reverse "J" when viewed from above. The second shelf portion 108 is also formed at an incline such that its inner perimeter portion is lower than its outer perimeter portion. Additionally, a protruding portion 109 is formed above the second shelf portion 108 so as to cover over the second shelf portion 108. During flushing, the accumulated water level in the bowl portion 102 rises from the initial accumulated water level to approximately the height at which the second shelf portion 108 is installed due to the inflow of flush water to the bowl portion 102. This means that the second shelf portion 108 is formed at a height below the first shelf portion 106 and above the initial accumulated water level.

Moreover, a second orifice 112 for issuing flush water is formed at the base end of the second shelf portion 108 positioned at the left rear of the bowl portion 102. Flush water issued from the second orifice 112 flows from a slit-shaped gap between the tip of a protruding portion 109 and the inner perimeter portion of the second shelf portion 108 along the second shelf portion 108 as it drops downward. In addition, essentially the entire volume of flush water flows downward when it reaches the second shelf front edge 108*a* after flowing along the second shelf portion 108.

A step portion 107 is formed at a position below the initial accumulated water level L at the lower portion of the bowl portion 102 on a near-horizontal inclined surface. When flushing, a portion of the flush water issued from the second orifice 112 and flowing down from the slit-shaped gap between the tip of the protruding portion 109 and the inner perimeter portion of the second shelf portion 108 jump upward and then again flows downward. The step portion 107 is formed to extend from the front of the bowl portion 102 to the tip portion 107*a*. As shown in FIG. 4, the slit-shaped gap through which flush water falls extends further back than the tip portion 107*a*, therefore flush water flowing down from the part where no slit-shaped gap step portion is 107 formed moves toward the bottom of the bowl portion 102 as is without colliding with the step portion 107. On the other hand, flush water flowing from the upper part of the step portion 107 within the slit-shaped gap does collide with the step portion 107 and is caused to jump upward.

A flow path inlet 118 is formed on the rear edge of the flush toilet 100, and flush water guided from this flow path inlet 118 passes through the shared water path 120 to flow toward the front of the flush toilet 100.

The shared water path 120 is divided into a first flow path 114 and a second flow path 116. The first flow path 114 is constituted to extend from the shared water path 120 branching point up to the first orifice 110. The second flow path 116 is constituted to connect from the shared water path 120 branching point to the second orifice 112. In the present embodiment, approximately ⅓ of the flush water flowing in from the flow path inlet 118 flows into the first flow path 114, and approximately ⅔ flows into the second flow path 116.

Next we explain the action of the flush toilet 100 according to the second embodiment of the present invention.

First, in the flush toilet 100 in the standby state, accumulated water is accumulated up to an initial accumulated water level L. When a user begins flushing the bowl portion 102, flush water flows into the flow path inlet 118 and passes through the shared water path 120 to be divided between the first flow path 114 and the second flow path 116.

Flush water issued from the bowl portion 102 first orifice 110 flows in a swirl along the first shelf portion 106. Flush water issued from the first orifice 110 flows down as it swirls around the edge of the bowl portion 102, and flush water reaches the bottom of the bowl portion 102 by describing approximately a spiral. The waste-receiving surface 102*b* of the bowl portion 102 is thus cleaned.

Flush water issued from the second orifice 112 at the left rear of the bowl portion 102 moves along the second shelf portion 108 toward the front of the bowl portion 102 and reaches the second shelf front edge 108*a*. Flush water issued from the second orifice 112 flows along the second shelf portion 108 and flows downward into the bowl portion 102 from the slit-shaped gap between the tip of the protruding portion 109 and the inner perimeter portion of the second shelf portion 108. Moreover, flush water which flows along the second shelf portion 108 and hits the second shelf front edge 108*a* falls downward from that point, such that it flows downward from the front of the second shelf portion 108 and moves waste toward the trap pipe 104 inlet 104*a*. Flush water flowing down from the second shelf portion 108 stirs the accumulated water in the bowl portion 102 and causes floating waste which had been floating on the surface of the accumulated water prior to flushing to be moved toward the bottom of the bowl portion 102. Moreover, a portion of the flush water flowing down from the second shelf portion 108 and colliding with the step portion 107 jumps upward and then again flows downward, thereby strengthening the up and down stirring action of the flush water to effectively pull the floating waste into the accumulated water. Flush water flowing down from the second shelf portion 108 and moving toward the bottom of the bowl portion 102 without colliding with the step portion 107 causes floating waste to be pulled toward the trap pipe 104 inlet 4*a*, effectively expelling it to the outlet 104*c*.

As flush water is issued from the first orifice 110 and the second orifice 112, the accumulated water level in the bowl portion 102 gradually rises. The rising accumulated water level reaches the vicinity of the second shelf portion 108 height, therefore floating waste floating on the accumulated water surface can be efficiently caused to sink into the accumulated water by the flush water flowing down from the second shelf portion 108.

The rising accumulated water level finally begins to fall after the accumulated water level has risen to reach the top height. At this point, waste which had sunk in the accumulated water in the bowl portion 102, and floating waste which had been floating on the accumulated water surface prior to flushing and was caused to sink into the accumulated water by the flow of flush water, pass over the highest point 104*b* of the trap pipe 104 together with the flush water and are expelled from the outlet 4*c* to a sewer pipe (not shown). After all waste is expelled, the accumulated water level drops even further and descends to the initial accumulated water level L. The flush toilet 100 of the present embodiment is a wall-hung toilet in which for structural reasons almost no siphon action is generated, and the accumulated water level never goes below the initial accumulated water level L during the entire period of flushing of the bowl portion 102.

In the flush toilet of the second embodiment of the present invention, a large portion of the flush water from the second shelf portion flows down from the front of the bowl portion toward the trap pipe, making it possible to aid the expulsion of waste in the bowl to the trap pipe so as to increase waste expelling performance.

Next, referring to FIGS. 7 through 9, we explain a flush toilet according to a third embodiment of the present invention. The flush toilet of the present embodiment differs from the first embodiment of the present invention in that the second orifice is disposed on the front of the bowl portion, facing the trap pipe. Therefore we will explain only those parts of the third embodiment of the present invention which differ from the first embodiment, and will omit an explanation of similar parts. FIG. 7 is a side elevation section of a flush toilet according to the third embodiment of the present invention; FIG. 8 is a plan view thereof FIG. 9 is a front elevation section along line IX-IX in FIG. 9.

As shown in FIGS. 7 through 9, the flush toilet 200 according to the third embodiment of the invention has a bowl portion 202 and a trap pipe 204 connecting from the bottom of the bowl portion 202 and extending therefrom. Also, the flush toilet 200 according to the present embodiment is constituted as a wall-hung toilet.

A rim portion 202*a* and a waste-receiving surface 202*b* are formed on the bowl portion 202; the shapes thereof are the same as the first embodiment, hence an explanation thereof is here omitted.

The trap pipe 4 has an inlet 204*a*, a highest point 204*b*, and an outlet 204*c*; the shapes thereof are the same as the first embodiment, hence an explanation thereof is here omitted. The initial accumulated water level L, which is the accumulated water level during standby, is determined by the height of the highest point 204*b* of the trap pipe 204.

A first shelf portion 206 extending on an essentially horizontal plane is formed along the bowl portion 202 rim portion 202*a*. The shape of this first shelf portion 206 is also the same as the first embodiment, hence an explanation thereof is here omitted.

Moreover, a first orifice 210 for issuing flush water is formed at the base end of the first shelf portion 206, which is positioned at the left rear of the bowl portion 202. The flush water issued from the first orifice 210 drops downward while swirling over the inner perimeter of the rim portion 202*a* along the first shelf portion 206, flushing the waste-receiving surface 202*b*.

Supply of water to this second orifice 212 is accomplished via a second flow path 216 disposed on the bottom surface side of the bowl portion 202, which extends from the left rear of the bowl portion 202 to describe a reverse "J" when viewed from above. In addition, a second flow path 216 extends from the left rear of the bowl portion 202 and connects to a shared water path 220 described below. When flushing, the accumulated water level in the bowl portion 202 rises from an initial accumulated water level to approximately the height at which the second orifice 212 is installed, due to the inflow of flush water to the bowl portion 202. Therefore the second orifice 212 is formed below the first shelf portion 206 and above the initial accumulated water level.

Moreover, a flow path inlet 218 for guiding flush water issued from the first orifice 210 and the second orifice 212 is formed at the rear edge of the flush toilet 200. Flush water guided into the flush toilet 200 is supplied to the flow path inlet 218 via a flush valve (not shown) in the water supply. Additionally, flush water guided into the flush toilet 200 from the flow path inlet 218 flows through a shared water path 220 toward the front of the flush toilet 200.

A step portion 207 constituted as a near-horizontal inclined surface is formed at a position lower than the initial accumulated water level L at the lower part of the bowl portion 202. During flushing, the flush water issued and flowing down from the second orifice 212 collides with the step portion 207; a portion of the colliding flush water jumps up and again flows downward.

The shared water path 220 is divided at the rear of the bowl portion 202 between a first flow path 214 extending in an essentially horizontal direction along the rear of the bowl portion 202 and a second flow path 216 extending downward from the shared water path 220. The first flow path 214 is constituted to extend along the rear edge of the bowl portion 202 in a horizontal direction from the dividing point on the shared water path 220 to the first orifice 210 on the left rear of the bowl portion 202. The second flow path 216 extends from the dividing point on the shared water path 220 essentially vertically downward, following which it extends in a horizontal direction, bending forward at essentially the same height as the second orifice 212. In addition, the forward-bending second flow path 216 extends over the bottom surface of the bowl portion 202 to describe a reverse "J" as seen from above, connecting to the second orifice 212. In the present embodiment approximately ⅓ of the flush water flowing in from the flow path inlet 218 flows into the first flow path 214, and approximately ⅔ flows into the second flow path 216.

Next we explain the action of the flush toilet 200 according to the third embodiment of the present invention.

First, in the flush toilet 200 in the standby state, accumulated water in the bowl portion 202 is accumulated up to the initial accumulated water level L, which is the height of the highest point 204*b*. When the user operates the flush valve (not shown), flush water flows from the water supply line into the flow path inlet 218; after flush water flows through the shared water path 220 it is divided into the first flow path 214 and the second flow path 216.

Approximately ⅓ of the flush water flowing into the shared water path 220 flows into the first flow path 214 and is issued from the first orifice 210. Flush water issued from the first orifice 210 flows in a swirl within the bowl portion 202 along the first shelf portion 206. Flush water issued from the first orifice 210 flows downward toward the interior of the bowl portion 202 as it swirls, therefore the flush water reaches the bottom of the bowl portion 202 by describing an approximately spiral form. The waste-receiving surface 202*b* of the bowl portion 202 is thus cleansed by this spiral-shaped flow of the flush water. Because the rim portion 202*a* is formed to protrude inward, the flush water issued from the first orifice 210 does not fly out of the bowl portion 2 due to centrifugal force.

At the same time, approximately ⅔ of the flush water flowing into the shared water path 220 flows into the second flow path 216 and is issued from the second orifice 212. The second flow path 216 branching off from the shared water path 220 at the left rear of the bowl portion 202 is first directed vertically downward, then moves horizontally toward the front of the bowl portion 202 and is connected to the second orifice 212. Flush water issued from the second orifice 212 flows toward the trap pipe 204 inlet 204*a*, stirs the accumulated water in the bowl portion 202, and moves floating waste which had been floating on the accumulated water surface toward the inlet 204*a* opened at the bottom of the bowl portion 202. Moreover, flush water which flowed downward from the second orifice 212 and collided with the step portion 207 jumps upward and then again flows downward, thereby strengthening the up and down stirring action of the flush water such that floating waste is effectively pulled into the accumulated water.

When flush water is issued from the first orifice 210 and the second orifice 212 and begins to flow into the bowl portion 202, the accumulated water level in the bowl portion 202 gradually rises. The rising accumulated water level reaches the vicinity of the second orifice 212 height, therefore floating waste floating on the accumulated water surface can be efficiently caused to sink into the accumulated water by the flush water flowing down from the second orifice 212.

The rise of the accumulated water level causes an increase in the flow volume of flush water passing over the highest point 204 of the trap pipe 204 to be expelled, and reduces the flow volume of flush water flowing into the flush valve (not shown), such that the raised accumulated water level finally begins to be lowered. At this point, waste which had sunk in the accumulated water in the bowl portion 202 and floating waste which had been floating on the accumulated water surface prior to flushing and was caused to sink into the accumulated water by the flow of flush water are expelled into a sewer pipe (not shown) from the trap pipe 204 outlet 204*c*, together with the flush water. After all waste is expelled, the accumulated water level drops even further and descends to the initial accumulated water level L. The flush toilet 200 of the present embodiment is a wall-hung toilet, in which for structural reasons almost no siphon action is generated, and the accumulated water level never goes below the initial accumulated water level L during the entire period of the flushing of the bowl portion 202.

According to the flush toilet in the third embodiment of the present invention, flush water issued from the second orifice stirs flush water in the bowl portion, thereby enabling effective expelling of floating waste without the use of siphon action even in flushing systems utilizing swirl flows.

In the flush toilet of the present invention, the second orifice is formed at essentially the same height as the height to which the accumulated water level rises in the bowl portion during flushing, therefore accumulated water in the bowl portion can be effectively stirred by flush water flowing down from the second orifice. In addition, flush water from the second orifice flows into the bowl portion from immediately above the accumulated water level, therefore there is no collision with flush water flowing downward from the first shelf portion as it swirls, and no water splashing is induced. Moreover, flush water from the second orifice flows down from the front of the bowl portion toward the trap pipe inlet, making it possible to aid the expelling of waste in the bowl portion to the trap pipe and thereby improve waste expelling performance.

We have thus explained preferable embodiments of the present invention, but a variety of modifications may be applied to embodiments described above. In particular, in the embodiments described above, the present invention was applied to water supply direct-linked flush toilets in which flush water is directly supplied from a water pipe, but the present invention may also be applied to a tank-type flush toilet in which flush water is supplied from a flush water tank. In that case, flushing of the flush toilet is commenced when a user operates a lever on the flush water tank; when flush water in the flush water tank is reduced by a predetermined amount, supply of flush water to the flush toilet is stopped.

Moreover, in the embodiments described above, the second shelf portion and the second orifice (third embodiment) were formed in the vicinity of the highest accumulated water level reached during flushing, but the second shelf portion and the second orifice could also be formed even higher. In this case it is preferable to form the second shelf portion and the second orifice at a height at which there is no water splashing caused by collision with flush water issued from the first orifice.

Also, in the embodiments described above, the present invention was applied to a wall-hung flush toilet, but it is also extremely effective to apply the present invention to floor-mounted flush toilets in which no siphon action is generated or in which siphon action is weak. The present invention can also be applied to a flush toilet in which siphon action is generated.

A side elevation section of a flush toilet according to a first embodiment of the present invention.

FIG. 2

A plan view of a flush toilet according to a first embodiment of the present invention.

FIG. 3

Figure 1:
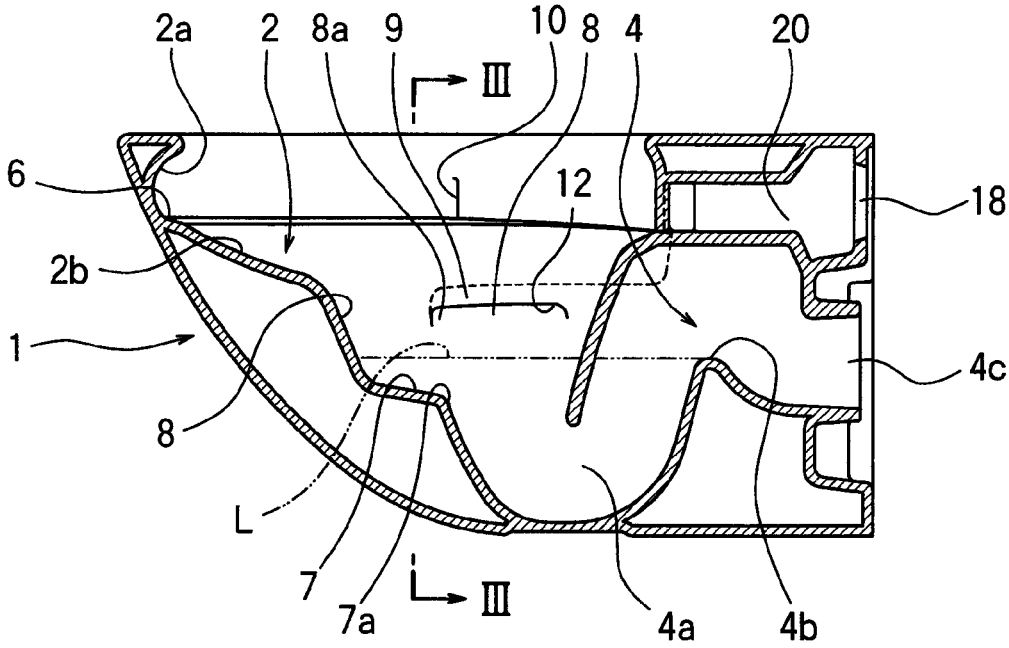
FIG. 1
Figure 2:
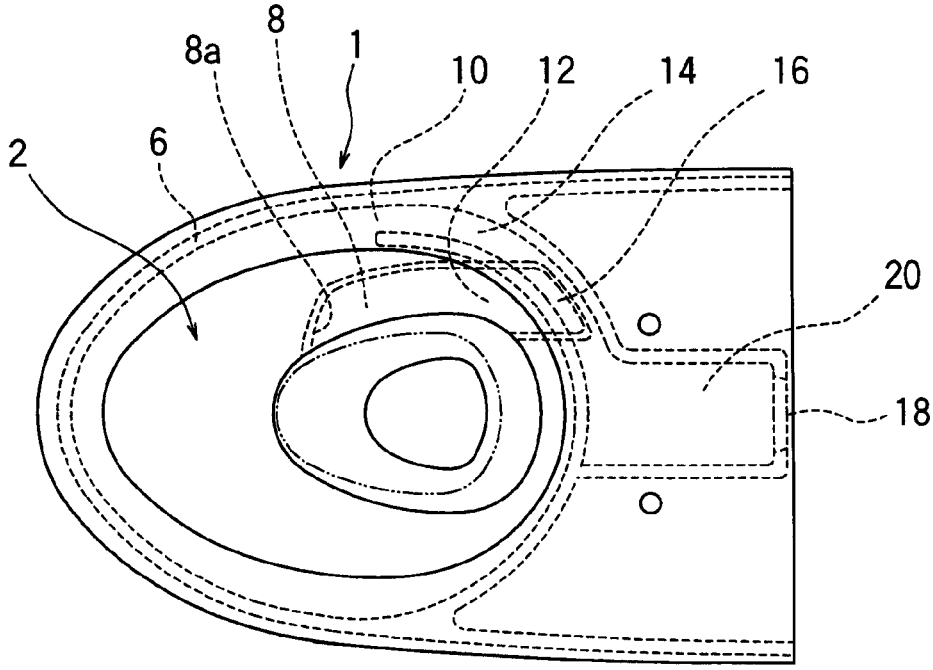
Figure 3:
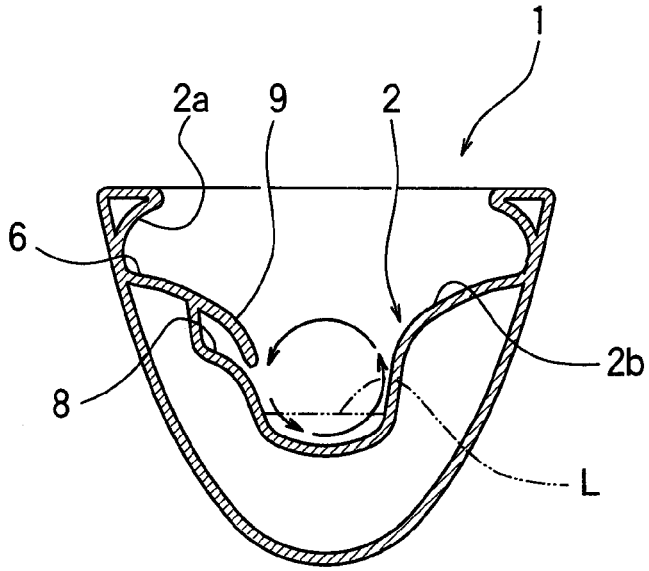

A front elevation section along line III-III in FIG. 1 of a flush toilet according to a first embodiment of the present invention.

FIG. 4

A side elevation section of a flush toilet according to a second embodiment of the present invention.

FIG. 5

A plan view of a flush toilet according to a second embodiment of the present invention.

FIG. 6

Figure 4:
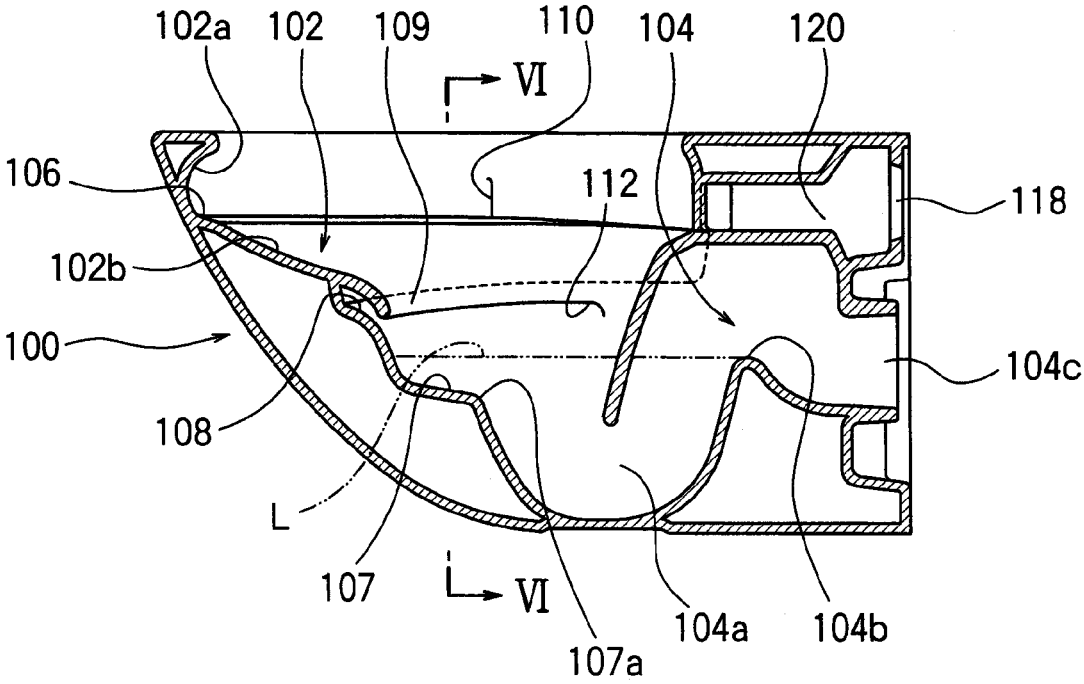
Figure 5:
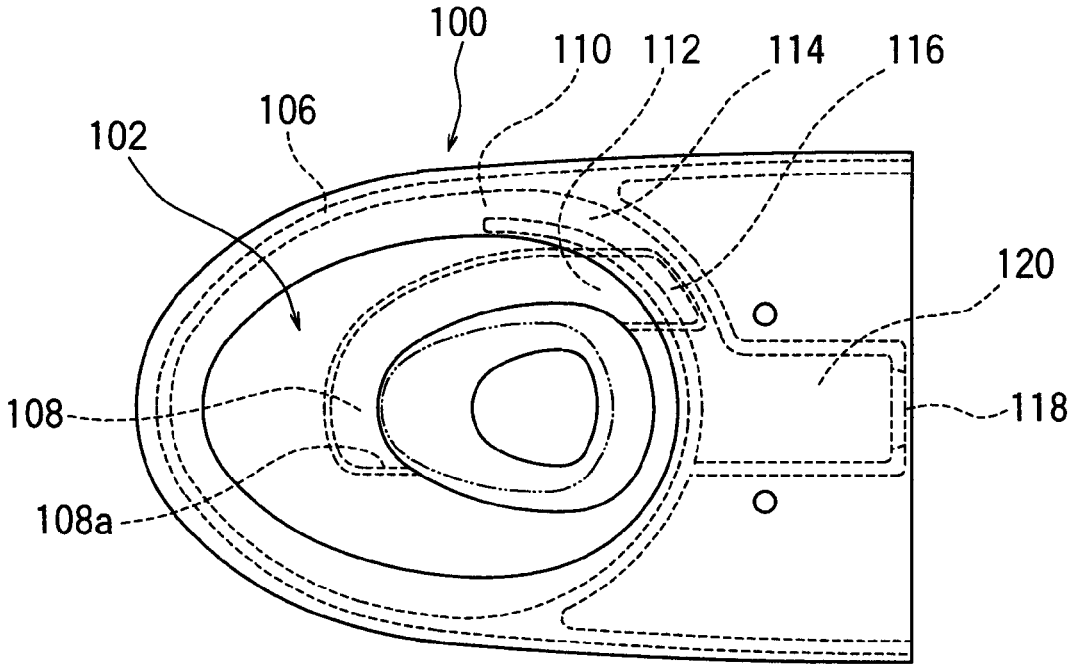
Figure 6:
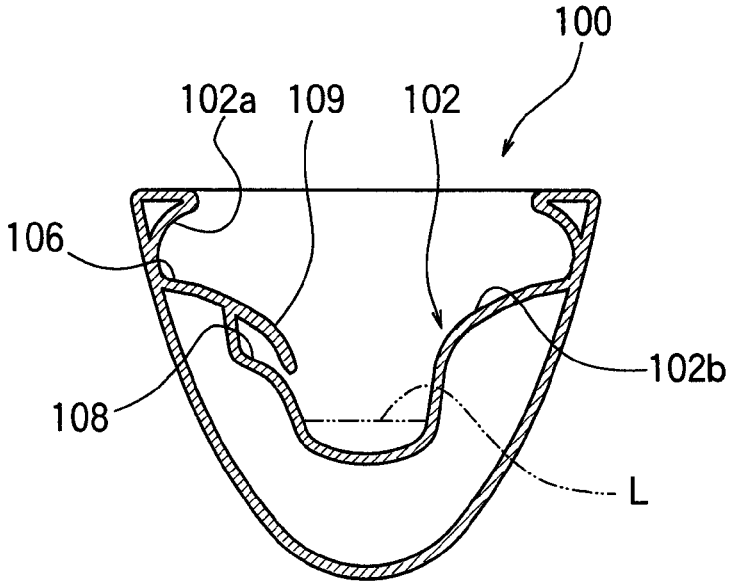

A front elevation section along line VI-VI in FIG. 4 of a flush toilet according to a second embodiment of the present invention.

FIG. 7

A side elevation section of a flush toilet according to a third embodiment of the present invention.

FIG. 8

A plan view of a flush toilet according to a third embodiment of the present invention.

FIG. 9

Figure 7:
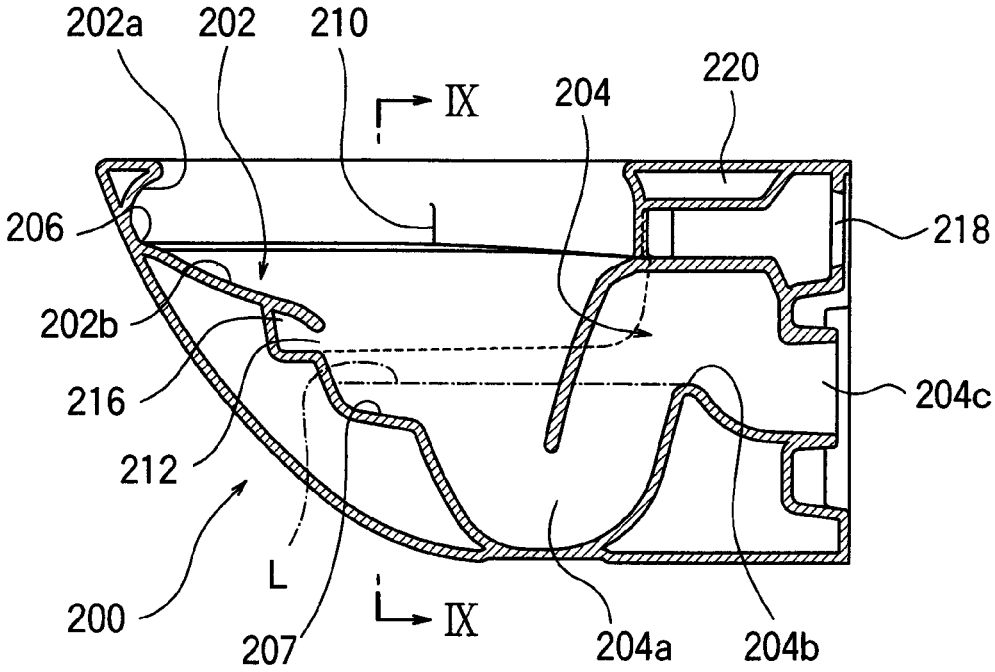
Figure 8:
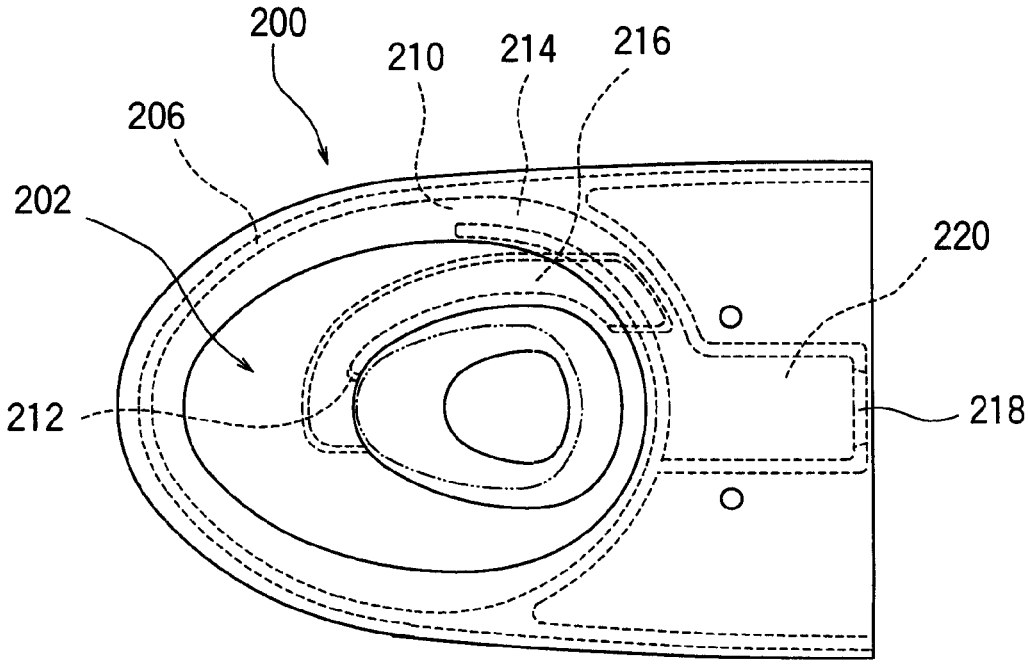
Figure 9:
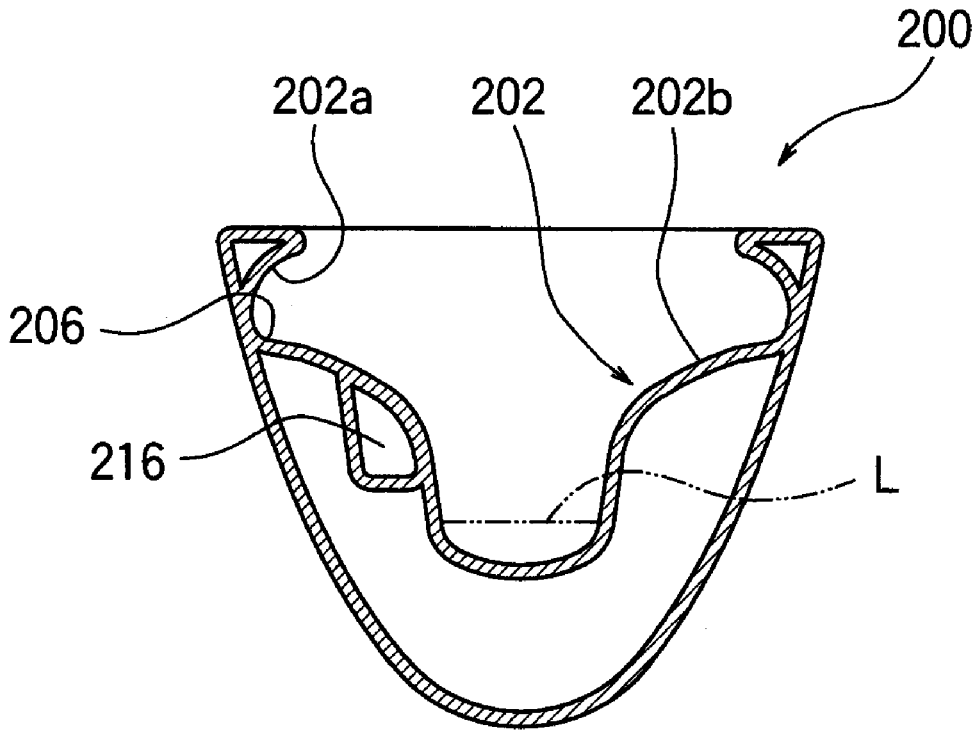

A front elevation section along line IX-IX in FIG. 7 of a flush toilet according to a second embodiment of the present invention.

EXPLANATION OF REFERENCE NUMERALS

L Initial accumulated water level
1 A flush toilet according to a first embodiment of the present invention
2 Bowl portion
2*a* Rim portion
2*b* Waste-receiving surface
4 Trap pipe
4*a* Inlet
4*b* Highest point
4*c* Outlet
6 First shelf portion
7 Step portion
7*a* Tip portion
8 Second shelf portion
8*a* Second shelf portion tip
9 Protruding portion
10 First orifice
12 Second orifice
14 First flow path
16 Second flow path
18 Flow path inlet
20 Shared water path
100 A flush toilet according to a second embodiment of the present invention
102 Bowl portion
102*a* Rim portion
102*b* Waste-receiving surface
104 Trap pipe
104*a* Inlet
104*b* Highest point
104*c* Outlet
106 First shelf portion
107 Step portion
107*a* Tip portion
108 Second shelf portion
108*a* Second shelf portion tip
109 Protruding portion
110 First orifice
112 Second orifice
114 First flow path
116 Second flow path
118 Flow path inlet
120 Shared water path
200 A flush toilet according to a third embodiment of the present invention
202 Bowl portion
202*a* Rim portion
202*b* Waste-receiving surface
204 Trap pipe
204*a* Inlet
204*b* Highest point
204*c* Outlet
206 First shelf portion
207 Step portion
210 First orifice
212 Second orifice
214 First flow path
216 Second flow path
218 Flow path inlet
220 Shared water path

The invention claimed is:

1. A flush toilet in which flush water cleanses the toilet and expels waste without using a significant siphon action, comprising:

a bowl portion having a bowl-shaped waste-receiving surface and a rim portion, the inside wall surface on the top edge of which protrudes inward;

a trap pipe connected to and extending from the bottom of the bowl portion to expel waste, and defining the initial accumulated water level of the bowl portion;

a first shelf portion formed on the top edge of the waste-receiving surface adjacent to and below the rim portion;

a second shelf portion formed on the waste-receiving surface below the first shelf portion extending from a back portion of the bowl portion to at least a side portion of the bowl portion and having a portion which extends above the initial accumulated water level;

a protruding portion formed on the waste-receiving surface adjacent an upper region of the second shelf portion so as to at least partially cover the second shelf portion;

a first orifice for issuing flush water onto the first shelf portion, forming a swirl flow on the waste-receiving surface;

a second orifice for issuing flush water onto the second shelf portion, to discharge flush water from a gap between the protruding portion and an inner perimeter portion of the second shelf portion, the gap being positioned at the side portion of the bowl portion, such that the flush water discharged from the gap collides with a part of the bowl portion to induce up and down stirring flow of the flush water in the bowl portion and causes an accumulated water level to rise substantially above the initial accumulated water level;

a first flow path for supplying flush water to the first orifice; and a second flow path for supplying flush water to the second orifice.

2. The flush toilet according to claim 1, wherein the second shelf portion is formed in the vicinity of the highest height to which the accumulated water level rises in the bowl portion when flushing.

3. The flush toilet according to claim 1, wherein the second shelf portion extends from the back portion of the bowl portion to a front portion of the bowl portion.

4. The flush toilet according to claim 1, wherein an accumulated water level in the bowl portion never goes below the initial accumulated water level when the toilet is flushed.

5. The flush toilet according to claim 1, wherein the trap pipe outlet is connected to sewer piping disposed on a wall surface.

6. The flush toilet according to claim 1 constituted as a wall-hung flush toilet.

7. The flush toilet according to claim 1, wherein the bowl portion includes a step portion formed on a down stream area from the gap in the bowl portion and at a position lower than the gap and higher than the bottom of the bowl portion.

8. The flush toilet according to claim 7 wherein the step portion is at least partially overlapping a width of the second orifice, the step portion causing a portion of the flush water issued from the second orifice to be forced upward to increase the up and down stirring flow of the flush water in the bowl portion.

9. The flush toilet of claim 8, wherein the step portion is near-horizontal.

10. The flush toilet of claim 7, wherein the step portion is formed at a position lower than the initial accumulated water level.

11. The flush toilet of claim 1, wherein the up and down stirring flow is formed as a rotational flow about a generally horizontal axis extending from a back of the bowl to a front of the portion.

12. The flush toilet of claim 1, wherein the accumulated water level rises to about the second shelf portion.

13. A flush toilet in which flush water cleanses the toilet and expels waste without using a significant siphon action, comprising:

a bowl portion having a bowl-shaped waste-receiving surface and a rim portion, the inside wall surface on the top edge of which protrudes inward;

a trap pipe connected to and extending from the bottom of the bowl portion to expel waste, and defining the initial accumulated water level of the bowl portion;

a first shelf portion formed on the top edge of the waste-receiving surface adjacent to and below the rim portion;

a second shelf portion formed on the waste-receiving surface below the first shelf portion and having a portion which extends above the initial accumulated water level;

a protruding portion formed on the waste-receiving surface adjacent an upper region of the second shelf portion so as to at least partially cover the second shelf portion;

a first orifice for issuing flush water onto the first shelf portion, forming a swirl flow on the waste-receiving surface;

a second orifice for issuing flush water onto the second shelf portion, to discharge flush water from a gap between the protruding portion and an inner perimeter portion of the second shelf portion, the gap being positioned at a side portion of the bowl portion, to induce up and down stirring flow of flush water in the bowl portion;

a step portion formed on a down stream area from the gap in the bowl portion and at a position lower than the gap and higher than the bottom of the bowl portion to at least partially overlap with the gap, the step portion causing a portion of the flush water discharged from the gap to be forced upward to increase the up and down stirring flow of the flush water in the bowl portion;

a first flow path for supplying flush water to the first orifice; and a second flow path for supplying flush water to the second orifice.

14. The flush toilet of claim 13, wherein the up and down stirring flow is formed as a rotational flow about a generally horizontal axis extending from a back of the bowl to a front of the portion.

15. The flush toilet of claim 13, wherein the step portion is formed at a position lower than the initial accumulated water level.

16. The flush toilet of claim 13, wherein the step portion is near-horizontal.

17. The flush toilet of claim 13, wherein the gap is elongated and slit-shaped.

* * * * *

UNITED STATES PATENT AND TRADEMARK OFFICE

CERTIFICATE OF CORRECTION

PATENT NO. : 7,827,628 B2
APPLICATION NO. : 11/836518
DATED : November 9, 2010
INVENTOR(S) : Tomoyasu Ichiki It is certified that error appears in the above-identified patent and that said Letters Patent is hereby corrected as shown below:

Column 16, Line 4, Claim 11:

Delete "to a front of the portion" and
Insert -- to a front of the bowl portion --.

Column 16, Line 48, Claim 14:

Delete "to a front of the portion" and
Insert -- to a front of the bowl portion --.

Signed and Sealed this
Eighth Day of February, 2011

David J. Kappos

David J. Kappos
*Director of the United States Patent and Trademark Office*